US006286831B1

(12) United States Patent
Marasco et al.

(10) Patent No.: US 6,286,831 B1
(45) **Date of Patent: *Sep. 11, 2001**

(54) OPTIMIZED PASSIVE GATE INVERTER

(75) Inventors: Joseph Marasco, Fairport; David M. Attridge, Rochester, both of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/707,643

(22) Filed: Nov. 7, 2000

Related U.S. Application Data

(62) Division of application No. 09/143,874, filed on Aug. 31, 1998.

(51) Int. Cl.[7] ..... B65H 29/00

(52) U.S. Cl. ..... 271/303; 271/305; 271/186; 271/185; 271/184

(58) Field of Search ..... 271/303, 305, 271/184, 185, 186

(56) References Cited

U.S. PATENT DOCUMENTS

| | | | |
|---|---|---|---|
| 3,416,791 | 12/1968 | Beckman, Jr. et al. | 271/65 |
| 4,475,156 | 10/1984 | Federico et al. | 364/300 |
| 4,493,483 | 1/1985 | Teumer et al. | 271/186 |
| 4,731,637 | 3/1988 | Acquaviva et al. | 355/14 SH |
| 4,794,429 | 12/1988 | Acquaviva | 355/76 |
| 4,916,493 | 4/1990 | DeVito | 355/321 |
| 4,961,092 | 10/1990 | Rabb et al. | 355/323 |
| 5,014,976 | 5/1991 | Muck et al. | 271/220 |
| 5,317,377 | 5/1994 | Rubscha | 355/319 |
| 5,449,164 | 9/1995 | Quesnel | 271/186 |
| 5,570,877 | 11/1996 | Asami et al. | 271/186 |
| 5,689,795 | 11/1997 | Mastrandrea | 399/407 |
| 5,710,968 | 1/1998 | Clark et al. | 399/382 |
| 6,186,496 * | 2/2001 | Marasco et al. | 271/186 |

* cited by examiner

*Primary Examiner*—David H. Bollinger
(74) *Attorney, Agent, or Firm*—Andrew D. Ryan

(57) ABSTRACT

In accordance with one aspect of the invention, there is provided an apparatus for guiding a sheet in a stream of sheet progressing through a paper path of a printing machine. The apparatus includes an input feed mechanism for feeding the sheets in a first direction. The apparatus also includes a guide which is operably associated with the input feed mechanism for guiding the sheets along the first direction. The apparatus further includes a movable gate operably associated with the guide. The gate and the guide define a passageway therebetween for passing sheets therethrough. The passageway has a first width at a first position of the gate selected for passing sheets therethrough having a thickness less than a first thickness. The first width of the passageway is selected for inhibiting sheets therethrough having a thickness greater than the first thickness. The passageway has a second width at a second position of the gate spaced from the first position selected for passing sheets therethrough having a thickness up to a second thickness. The second width of the passageway is selected for inhibiting sheets therethrough having a thickness greater than the second thickness. The second thickness is greater than the first thickness.

19 Claims, 6 Drawing Sheets

OPTIMIZED PASSIVE GATE INVERTER

This application is a divisional of application Ser. No. 09/143,874, filed Aug. 31, 1998.

The present invention relates to feeding substrates through an electrophotographic printing machine. More particularly, the invention relates to compiling sheets into a set of printed sheets.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

High speed copying machines are becoming increasingly popular. These machines have a capacity or output capacity of say, for example, over 60 copies per minute. These machines are able to use single cut sheets of paper of various size such as A4, 8½×11, or 8½×14 inch copy sheets. These machines may be of the light lens, xerographic machine or may be a printer with digital input. Single, cut sheet printing machines are now available at speeds around 200 cpm.

The present invention relates to an improved sheet inverting system, and more particularly, to an inverter adapted to be placed within the normal paper path of a copier while providing improved handling of variable size sheets, as well as, curled sheets within the inverter.

As xerographic and other copies increase in speed, and become more automatic, it is increasingly important to provide higher speed yet more economical, reliable and more automatic handling of both the copy sheets being made by the copier and the original document sheets being copied. It is thus desired to accommodate sheets which may vary widely in size, weight, thickness, material, condition, humidity, age, etc.

These variations change the beam strength or flexural resistance, as well as, other characteristics of the sheets. Yet, the desire for automatic and high speed handling of such sheets without jams, misfeeds, uneven feeding times, or other interruptions increases the need for reliability of all sheet handling components. A sheet inverter is one such sheet handling component with particular reliability problems and sheet handling size and capability limitations.

Although a sheet inverter is referred to in the copier art as an inverter, its function is not necessary to immediately turn the sheet over (i.e., exchange one face for the other). Its function is to effectively reverse the sheet orientation in its direction of motion. That is, to reverse the lead edge and trail edge orientation of the sheet.

Typically, in an inverting device, the sheet is driven or fed by feed rollers or other suitable sheet driving mechanisms into a sheet reversing chute. By then, reversing the motion of the sheet within the chute and feeding it back out from the chute, the desired reversal of the leading and trailing edges of the sheet in the sheet path is accomplished.

Depending on the location and orientation of the inverter in a particular sheet path, this may, or may not, also accomplish the inversion (turning over) of the sheet. In some applications for example, where the (inverter) is located at a corner of a 90° to 180° inherent bend in the copier sheet path, the inverter may be used to actually prevent inverting of a sheet at that point, i.e., to maintain the same side of the sheet face-up before and after this bend in the sheet path. On the other hand, if the entry and departing path of the sheet, to and from the inverter, is in substantially the same plane, the sheet will be inverted by the inverter. Thus, inverters have numerous applications in the handling of either original documents or copy sheets to either maintain, or change, the sheet orientation.

Inverters are particularly useful in various systems of pre- or post-collation copying, for inverting the original documents, or for maintaining proper collation of the sheets. The facial orientation of the copy sheet determines whether it may be stacked in forward or reverse serial order to maintain collation. Generally, the inverter is associated with a by-pass sheet path and gate so that a sheet may selectively by-pass the inverter, to provide a choice of inversion or noninversion.

Typically, in a reversing chute-type inverter, the sheet is fed in and then wholly or partially released from a positive feeding grip or nip into the inverter chute and then reacquired by a different feeding nip to exit the inverter chute. Such a temporarily loss of positive gripping of the sheet by any feeding mechanism during the inversion increases the reliability problems of such inverters.

As noted above, many inverters, particularly those utilizing only gravity, have reliability problems in the positive output or return of the sheet at a consistent time after the sheet is released in the inverter chute. Those inverters which use chute-drive rollers or other drive mechanisms of the type disclosed in U.S. Pat. No. 3,416,791 have a more positive return movement of the sheet, but this normally requires a movement actuator (collector solenoid) for the drive or and either a censor or a timing mechanism to determine the proper time to initiate the actuation of this drive mechanism so that it does not interfere with the input movement of the sheet, and only thereafter acts on the sheet to return it to the exit nip or other feed-out areas.

Further, inverter reliability problems are aggravated by variations in the condition or size of the sheet. For example, a preset curl in the sheet can cause the sheet to assume an undesirable configuration within the chute when it is released therein and interfere with the feed-out.

Further, copiers are typically required to utilize a wide range in sheet or media thickness or weight. For example, printing machines are required to utilize the lightest media (13# bond and lower) while also being able to utilize heavy, thick media such as index paper (110# weight or greater). Being able to invert paper with such a wide range of weight and stiffness is very difficult.

During the process of inverting a sheet, the sheet is directed toward an inverting chute along an inverter entry path. After the chute has been reversed, the sheet leaves the reversing chute through an inverter exit path. The leading edge of the sheet must be directed into the inverting chute and the leading edge of the sheet must be directed into the inverter exit path after the sheet has been reversed in the reversing chute.

A movable gate is typically used to direct the sheet into the inverting chute at the inverter entry path and to direct the sheet into the inverter exit path after it has been reversed in the inverting chute. A movable gate is typically used to direct the sheet into the inverting chute and to direct the sheet further into the inverter exit path. Typically, the movable gate is moved from a first position to a second position through the use of either a solenoid and cam device or a motor device.

The use of solenoid or motor devices to move a gate results in reliability and speed limitations because of the mechanical motions of the solenoid or motor. Further, the motion of the solenoid or motor must be timed with the entry of the sheet into the inverter chute and exit of the sheet from the inverter chute. These timing issues require either further slowdown of the processing speed in the printing machine or the use of additional sensors in the sheet path.

When a sheet enters the inverting path, the lead edge of the sheet may be curled. The curled lead edge of the sheet has a tendency to stub or become caught along the gate. The catching of the curled lead edge of a sheet in the gate may cause jams within the paper path.

Further, the gate typically requires the use of recesses or clearances within the guides along which the paper is directed during the inverting process in the inverting path. These recesses are sources for the curled lead edge of the sheets to catch and jam.

More recently, passive gates have been provided as more fully described in U.S. Pat. No. 5,317,377 assigned to Rubscha et al. and assigned commonly with the subject invention, the relative portions thereof incorporated herein by reference.

The use of such passive gates is plagued by the problem that such a passive gate is hard to accommodate all sheets. This is particularly true for sheets of various sizes and more particularly, for sheets of various weights or thicknesses. The passive gate is biased or sprung into a first position during entry and into a second position during the exit of the sheet from the inverter chute. The passive gate thus must move based on the lighter and more flexible sheet such as a bond sheet having a weight of #15 or #20. Such a delicate, light spring has serious reliability problems.

The optimized passive gate inverter of the present invention is intended to alleviate at least some of the problems heretofore mentioned.

The following disclosures relate to the area of inserting one or more insert sheets among a plurality of previously marked sheets:

U.S. Pat. No. 5,710,968
Patentee: Clark et al.
Issued: Jan. 20, 1998
U.S. Pat. No. 5,689,795
Patentee: Mastrandrea
Issued: Nov. 18, 1997
U.S. Pat. No. 5,449,164
Patentee: Quesnel et al.
Issued: Sep. 12, 1995
U.S. Pat. No. 5,317,377
Patentee: Rubscha et al.
Issued: May 31, 1994
U.S. Pat, No. 5,014,976
Patentee: Muck
Issued: May 14, 1991
U.S. Pat. No. 4,916,493
Patentee: DeVito
Issued: Apr. 10, 1990
U.S. Pat. No. 4,493,483
Patentee: Teumer et al.
Issued: Jan. 15, 1985
U.S. Pat. No. 3,416,791
Patentee: Beckman, Jr. et al.
Issued: Dec. 17,1968

The relevant portions of the foregoing disclosures may be briefly summarized as follows:

U.S. Pat. No. 5,710,968 discloses a dual path sheet feeder including a bypass transport loop and a main transport loop for selectively delivering sheets from a sheet feeding module to either a printer processing module or to a finishing module, wherein a movable gate situated adjacent to the bypass transport loop is provided for directing sheets along a predetermined path of travel. The movable gate is selectively positionable between a first position for directing the sheets through the main transport loop to the processing module to produce copy sheets prior to delivering the copy sheets to the finishing module and a second position for directing the sheets through the bypass transport loop to deliver sheets directly to the finishing module, circumventing the processing module. The dual path sheet feeder is contemplated for use in conjunction with a high speed electrostatographic printing machine for providing flexible paper supply options without the additional burden of providing supplemental dedicated sheet feeding trays.

U.S. Pat. No. 5,689,795 discloses a printing apparatus including a processing section for transferring a developed image onto a copy sheet and a finishing section for receiving plural copy sheets to generate a print set. The apparatus includes a first sheet feeding apparatus associated with the processing section for feeding the sheets through the processing station at a first translational speed and a second sheet feeding apparatus associated with the finishing section for feeding the sheets to the finishing section at a second translational speed. The apparatus also includes a sheet transfer apparatus for transferring the sheets from the first sheet feeding apparatus to the second sheet feeding apparatus, for changing the speed of the sheets from the first translational speed to the second translational speed and for positioning adjacent sheets in the second feeding apparatus in a spaced apart relationship therebetween defining a space between adjacent sheets. The apparatus further includes a controller operably connected to the sheet transfer apparatus for controlling the feeding of sheets through the sheet transfer apparatus to permit the space to be selectively determined.

U.S. Pat. No. 5,449,164 discloses a full productivity, tri-roll inverter for reversing the lead and trail edge of a sheet including an input nip and an output nip positioned to feed sheets at a machine's process speed into and out of a chute and a reversing roll nip positioned in a predetermined position along the chute closely adjacent to but downstream of the input and output nips and adapted to open and allow a sheet to be driven into the chute by the input nip and closed to drive a sheet into the output nip. After a first sheet is captured by the output nip, the reversing roll nip is opened and a second sheet is driven into the chute by the input nip while the first sheet is simultaneously being pulled out of the chute by the output nip.

U.S. Pat. No. 5,317,377 discloses a printer capable of producing simplex and duplex copies including a tri-roller inverter that employs a passive deflector gate downstream from input and output nips of the tri-roller inverter. A sheet driven by the input nip into a reversing chute of the inverter deflects the passive deflector gate to an open position that allows the sheet to enter the inversion chute and after the sheet is past the gate it returns to close deposition, thus allowing the sheet to be driven past it in reverse by a reversing roller. Once the lead edge of the reversed sheet passes the passive deflector gate, a second sheet enters the input nip resulting in two sheets being in the inverter at the same time.

U.S. Pat. No. 5,014,976 discloses, in a reproduction apparatus, outputting copy sheets via exit rollers to be stacked in an adjacent stacking tray, which exit rollers are also reversible to feed a selected copy sheet still in the nip back into the reproduction apparatus to be further processed, the previously outputted and stacking copy sheets are prevented from being recaptured by these reversed rotation exit rollers, by automatically interposing a one-way gate or trap and baffle between the stacking copy sheets and the exit rollers, to prevent accidental reacquisition of those sheets into the reversed rollers, but which gate or trap is automatically deflected out of the way of a sheet being outputted from the nip of the exit rollers by the outputted sheet itself, without requiring any other actuating mechanism. Preferably this is a deflectable portion of a unitary shield member, with a sheet edge catching lip on top thereof positioned and adapted to ride against the bottom of the selected sheet being reverse fed, to catch the edge of, and deflect into an integral concave sheet edge trap, any other sheet being dragged back with the selected sheet towards the nip of the rollers. Preferably an arcuate baffle portion also extends outside of the periphery of the bottom exit roller, which may also be so deflectable.

U.S. Pat. No. 4,916,493 discloses a, in a reproduction apparatus, outputting copy sheets via exit rollers and stacking the outputted copy sheets adjacent the exit rollers in a stacking tray, and which exit rollers are reversible in their direction of rotation to feed selected copy sheets imaged on one side back into the reproduction apparatus in a return path to be reimaged, an actuatable gate system prevents the previously outputted and stacking copy sheets from being recaptured by the reversed rotation exit rollers, by interposing a guide or baffle between the stacking copy sheets and the exit rollers to prevent accidental re-acquisition of copy sheets by the reversed rollers automatically in response to the reversal in direction of rotation of the exit rollers. The guide or baffle preferably comprises commonly rotatably mounted arcuate fingers closely adjacent the exit rollers, which fingers are automatically rotated to extend outside of the periphery of the exit rollers towards the stacking tray in response to the reversal in direction of rotation of the exit rollers. That may be accomplished by camming this finger rotation from an axial shifting of the exit rollers also providing lateral deregistration.

U.S. Pat. No. 4,493,483 discloses a reproduction machine adapted for producing copies of an original on both sides of a copy sheet and forwarding the finished copy to a collator. An inverter-reverser is employed which allows single-sided copy to a waiting station for subsequent processing to allow copying on the reverse side of the sheet to produce duplex copies, and for inverting duplex copies prior to delivery to the collator to provide the required sheet orientation in the collator. A sheet buckle control device cooperates with the inverter-reverser to insure that papers of widely different paper sizes, weights and stiffness will be inverted during the inverting stage of delivery of duplex copies.

U.S. Pat. No. 3,416,791 discloses an apparatus for selectively inverting the facing position of a conveyed document in which a document is inserted into a receiving chute from the normal path of travel, leading edge first, and withdrawn therefrom into the normal path of travel with the trailing edge becoming the leading edge.

As will be seen from an examination of the cited references, it is desirable to provide a printing machine with an inverter with faster response and that is more reliable.

In accordance with one aspect of the invention, there is provided an apparatus for guiding a sheet in a stream of sheet progressing through a paper path of a printing machine. The apparatus includes an input feed mechanism for feeding the sheets in a first direction and a guide. The guide is operably associated with the input feed mechanism for guiding the sheets along the first direction. The apparatus further includes a movable gate operably associated with the guide. The gate and the guide define a passageway therebetween for passing sheets therethrough. The passageway has a first width at a first position of the gate selected for passing sheets therethrough having a thickness less than a first thickness. The first width of the passageway is selected for inhibiting sheets therethrough having a art thickness greater than the first thickness. The passageway has a second width at a second position of the gate spaced from the first position selected for passing sheets therethrough having a thickness up to a second thickness. The second width of the passageway is selected for inhibiting sheets therethrough having a thickness greater than the second thickness. The second thickness is greater than the first thickness.

In accordance with another aspect of the present invention, there is provided an inverting apparatus for inverting a sheet selected from a stream of sheet progressing through a paper path of a printing machine. The apparatus includes an input feed mechanism for feeding the sheets in a first direction and a guide. The guide is operably associated with the input feed mechanism for guiding the sheets along the first direction. The apparatus also includes a movable gate operably associated with the guide. The gate and the guide define a passageway therebetween for passing sheets therethrough. The passageway has a first width at a first position of the gate selected for passing sheets therethrough having a thickness less than a first thickness. The first position of the gate is also selected for inhibiting sheets therethrough having a thickness greater than the first thickness. The passageway has a second width at a second position of the gate spaced from the first position selected for passing sheets therethrough having a thickness up to a second thickness. The second position of the gate is selected for inhibiting sheets therethrough having a thickness greater than the second thickness. The second thickness is greater than the first thickness. The apparatus further includes a reversing chute and a reversing feed mechanism. The reversing chute is operably associated with the guide for receiving the sheet for reversing thereof. The reversing feed mechanism is associated with the reversing chute for directing the sheet in a second direction opposed to the first direction.

In accordance with yet another aspect of the present invention, there is provided a printing machine including an inverting apparatus for inverting a sheet selected from a stream of sheet progressing through a paper path of a printing machine. The inverting apparatus includes an input feed mechanism for feeding the sheets in a first direction and a guide. The guide is operably associated With the input feed mechanism for guiding the sheets along the first direction. The apparatus also includes a movable gate operably associated with the guide. The gate and the guide define a passageway therebetween for passing sheets therethrough. The passageway has a first width at a first position of the gate selected for passing sheets therethrough having a thickness less than a first thickness. The first position of the gate is also selected for inhibiting sheets therethrough having a thickness greater than the first thickness. The passageway has a second width at a second position of the gate spaced from the first position selected for passing sheets therethrough having a thickness up to a second thickness. The second position of the gate is selected for inhibiting sheets therethrough having a thickness greater than the second thickness. The second thickness is greater than the first thickness.

The apparatus further includes a reversing chute and a reversing feed mechanism. The reversing chute is operably associated with the guide for receiving the sheet for reversing thereof. The reversing feed mechanism is associated with the reversing chute for directing the sheet in a second direction opposed to the first direction.

In accordance with yet another aspect of the present invention, there is provided a method of inverting a substrate. The method includes the steps of feeding the sheets in a first direction, selective diverting a selected sheet from a stream of sheets into an inverting path, guiding a first side of the sheet, selectively positioning the gate and the guide defining a passageway therebetween for passing sheets therethrough, the passageway having a first width at a first position of the gate selected for passing sheets therethrough having a thickness less than a first thickness and selected for inhibiting sheets therethrough having a thickness greater than the first thickness, the passageway having a second width at a second position of the gate spaced from the first position selected for passing sheets therethrough having a thickness up to a second thickness and selected for inhibiting sheets therethrough having a thickness greater than the second thickness, the second thickness being greater than the first thickness, receiving the sheet in a reversing chute for receiving the sheet for reversing thereof, and reversing the sheet in a reversing feed mechanism associated with the reversing sheet for directing the sheet in a second direction opposed to the first direction.

For a general understanding of the present invention, as well as other aspects thereof, reference is made to the following description and drawings, in which like reference numerals are used to refer to like elements, and wherein.

It is, therefore, apparent that there has been provided in accordance with the present invention, a optimized passive gate inverter that fully satisfies the aims and advantages hereinbefore set forth.

While the present invention will be described with a reference to preferred embodiments thereof, it will be understood that the invention is not to be limited to these preferred embodiments. On the contrary, it is intended that the present invention cover all alternatives, modifications, and equivalents as may be included within the spirit and scope of the invention as defined by the appended claims. Other aspects and features of the present invention will become apparent as the description proceeds.

Figure 1:
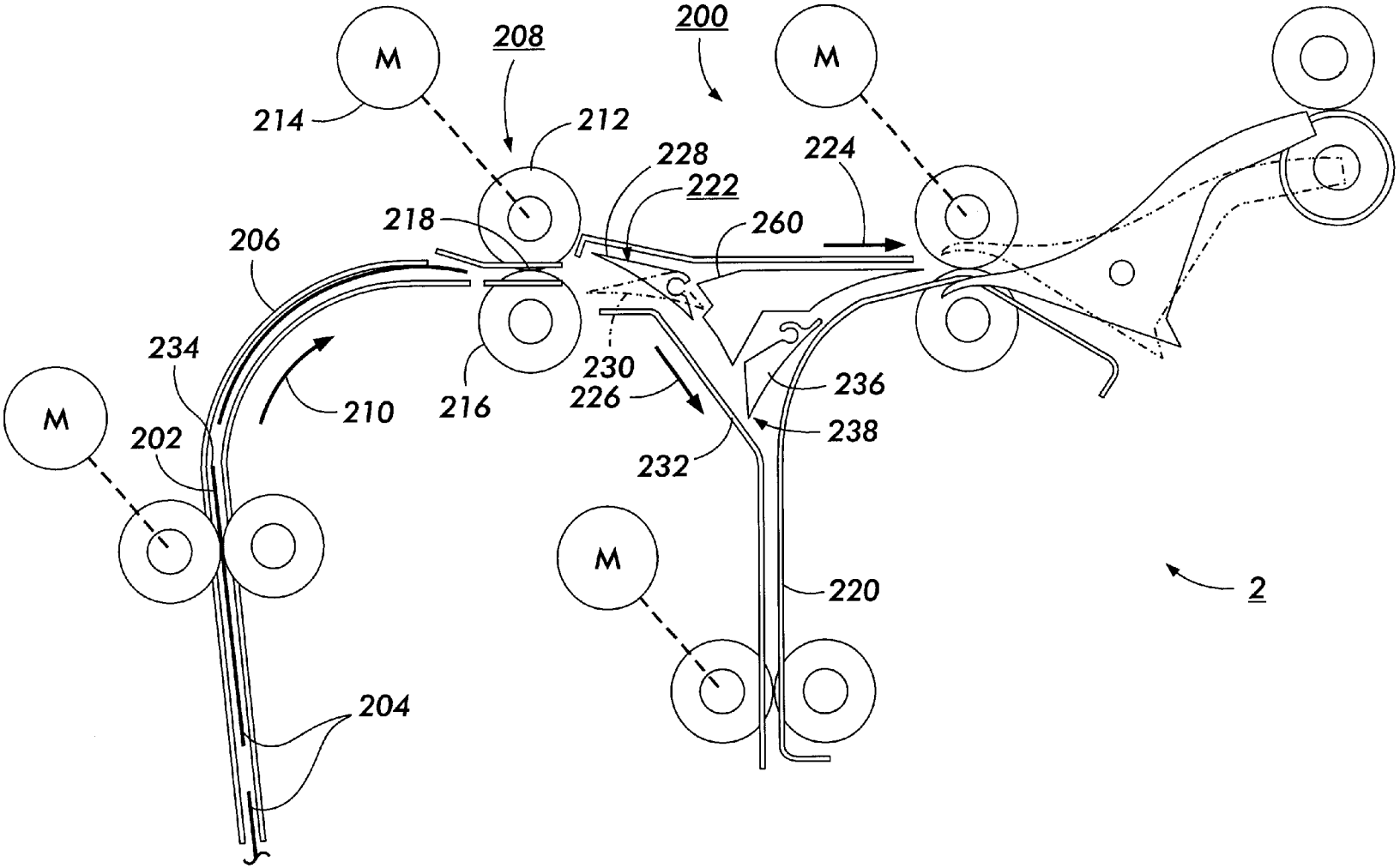
FIG. 1 is a schematic view of an optimized passive gate inverter according to the present invention.

In as much as the art of electrostatographic processing is well known, the various processing stations employed in a typical electrostatographic copying or printing machine of the present invention will initially be described briefly with reference to FIG. 1. It will become apparent from the following discussion that the optimized passive gate inverter of the present invention is equally well suited for use in a wide variety of other electrophotographic or electronic printing systems, as for example, ink jet, ionographic, laser based exposure systems, etc.

In FIG. 1, there is shown, in schematic form, an exemplary electrophotographic copying system 2 for processing, printing and finishing print jobs in accordance with the teachings of the present invention. For purposes of explanation, the copying system 2 is divided into a xerographic processing or printing section 6, a sheet feeding section 7, and a finishing section 8. The exemplary electrophotographic copying system 2 of FIG. 1 incorporates a recirculating document handler (RDH) 20 of a generally known type, which may be found, for example, in the well known Xerox Corporation models "1075", "5090" or "5100" duplicators. Such electrostatographic printing systems are illustrated and described in detail in various patents cited above and otherwise, including U.S. Pat. No. 4,961,092, the principal operation of which may also be disclosed in various other xerographic or other printing machines.

A printing system of the type shown herein is preferably adapted to provide, in a known manner, duplex or simplex collated print sets from either duplex or simplex original documents circulated by a document handler. As is conventionally practiced, the entire document handler unit 20 may be pivotally mounted to the copier so as to be liftable by an operator for alternative manual document placement and copying. In this manner, the exemplary printing system or apparatus 2 is designed to receive input documents as manually positioned on an optically transparent platen or automatically positioned thereon via a document handler, such as a recirculating document handler (RDH) 20, via a document handler input tray 21 or a document feeder slot 22.

The RDH 20 operates to automatically transport individual registered and spaced document sheets into an imaging station 23, platen operatively associated with the xerographic processing section 6. A platen transport system 24 is also provided, which may be incrementally driven via a non-slip or vacuum belt system controlled by a system controller 100 for stopping the document at a desired registration (copying) position in a manner taught by various references known in the art.

The RDH 20 has a conventional "racetrack" document loop path configuration, which preferably includes generally known inverting and non-inverting return recirculation paths for transporting original input documents back to the RDH loading and restacking tray 21. An exemplary set of duplex document sheets is shown stacked in this document tray 21. For clarity, the illustrated document and copy sheets are drawn here with exaggerated spacing between the sheets being stacked; in actual operation, these stacked sheets would be directly superposed upon one another. The RDH 20 may be a conventional dual input document handler, having an alternative semiautomatic document handling (SADH) side loading slot 22. Documents may be fed to the same imaging station 23 and transported by the same platen transport belt 24 from either the SADH input slot 22 at one side of the RDH 20, or from the regular RDH input, namely the loading or stacking tray 21, situated on top of the RDH unit. While the side loading slot 22 is referred to herein as the SADH feeding input slot 22, this input feeder is not limited to semi-automatic or "stream feed" document input feeding, but is also known to be usable for special "job interrupt" insert jobs. Normal RDH document feeding input comes from the bottom of the stack in tray 21 through arcuate, inverting RDH input path 25 to the upstream end of the platen transport 24. Input path 25 preferably includes a known "stack bottom" corrugated feeder-separator belt 26 and air knife 27 system including, document position sensors (not shown), and a set of turn baffles and feed rollers for inverting the incoming original documents prior to imaging.

Document inverting or non-inverting by the RDH 20 is further described, for example, in U.S. Pat. No. 4,794,429 or U.S. Pat. No. 4,731,637, among others. Briefly, input documents are typically exposed to a light source on the platen imaging station 23, or fed across the platen without being exposed, after which the documents may be ejected by the platen transport system 24 into downstream or off-platen rollers and further transported past a gate or a series of gates and sensors. Depending on the position of these gates, the documents are either guided directly to a document output path and then to a catch tray, or, more commonly, the documents are deflected past an additional sensor, and into an RDH return path 40. The RDH return path 40 provides a path for leading the documents back to tray 21 so that a document set can be continually recirculated. This RDH return path 40 includes reversible rollers to provide a choice of two different return paths to the RDH tray 21: a simplex return path 44 which provides sheet or document inversion or a reversible duplex return path 46 which provides no inversion, as will be further explained. For the duplex path 46, the reversible rollers are reversed to reverse feed the previous trail edge of the sheet back into the duplex return path 46 from an inverter chute 47. This duplex return path 46 provides for the desired inversion of duplex documents in one circulation as they are returned to the tray 21, for copying opposite sides of these documents in a subsequent circulation or circulations, as described in the above cited art. Typically, the RDH inverter and inversion path 46, 47 are used only for documents loaded in the RDH input tray 21 and for duplex documents. In normal operation, a duplex document has only one inversion per circulation (occurring in the RDH input path 25). By contrast, in the simplex circulation path there are two inversions per circulation, one in each of the paths 24 and 44, whereby two inversions per circulation is equivalent to no inversion such that simplex documents are returned to tray 21 in their original (face up) orientation via the simplex path 44.

The entire stack of originals in the RDH tray 21 can be recirculated and copied to produce a plurality of collated copy sets. In addition, the document set or stack may be recirculated through the RDH any number of times in order to produce any desired number of collated duplex print sets, that is, collated sets of duplex copy sheets, in accordance with various instruction sets known as print jobs which can be programmed into a controller 100, to operator which will be described.

Since the copy or print operation and apparatus of the present invention is well known and taught in numerous patents and other published art, the system will not be described in detail herein. Briefly, blank or preprinted copy sheets are conventionally provided by sheet feeder section 7, whereby sheets are delivered from a high capacity feeder tray 10 or from auxiliary paper trays 11 or 12 for receiving a copier document image from photoreceptor 13 at transfer station 14. In addition, copy sheets can be stored and delivered to the xerographic processing section 6 via auxiliary paper trays 11 or 12 which may be provided in an independent or stand alone device coupled to the electrophotographic printing system 2. After a developed image is transferred to a copy sheet, an output copy sheet is delivered to a fuser 15, and further transported to finishing section 8 (if they are to be simplex copies), or, temporarily delivered to and stacked in a duplex buffer tray 16 if they are to be duplexed, for subsequent return (inverted) via path 17 for receiving a second side developed image in the same manner as the first side. This duplex tray 16 has a finite predetermined sheet capacity, depending on the particular copier design. The completed duplex copy is preferably transported to finishing section 8 via output path 88. An optionally operated copy path sheet inverter 19 is also provided.

All document handler, xerographic imaging sheet feeding and finishing operations are preferably controlled by a generally conventional programmable controller 100. The controller 100 is additionally programmed with certain novel functions and graphic user interface features for the general operation of the electrostatographic printing system 2 and the dual path paper feeder of the present invention. The controller 100 preferably comprises a known programmable microprocessor system, as exemplified by the above cited and other extensive prior art (i.e., U.S. Pat. No. 4,475,156, and its references), for controlling the operation of all of the machine steps and processes described herein, including actuation of the document and copy sheet feeders and inverters, gates, etc. As further taught in the references, the controller 100 also conventionally provides a capability for storage and comparison of the numerical counts of the copy and document sheets, the number of documents fed and recirculated in a document or print set, the desired number of copy sets, and other functions which may be input into the machine by the operator through an input keyboard control or through a variety of customized graphic user interface screens. Control information and sheet path sensors (not shown) are utilized to control and keep track of the positions of the respective document and copy sheets as well as the operative components of the printing apparatus via their connection to the controller. The controller 100 may be conventionally connected to receive and act upon jam, timing, positional and other control signals from various sheet sensors in the document recirculation paths and the copy sheet paths. In addition, the controller 100 can preferably automatically actuate and regulate the positions of sheet path selection gates, including those gates associated with the dual path paper feeder, depending upon the mode of operation selected by the operator and the status of copying in that mode.

It shall be understood from the above description that multiple print jobs, once programmed, are scanned and printed and finished under the overall control of the machine controller 100. The controller 100 controls all the printer steps and functions as described herein, including imaging onto the photoreceptor, paper delivery, xerographic functions associated with developing and transferring the developed image onto the paper, and collation of sets and delivery of collated sets to the binder or stitcher, as well as to the stacking device 98. The printer controller 100 typically operates by initiating a sequencing schedule which is highly efficient in monitoring the status of a series of successive print jobs to be printed and finished in a consecutive fashion. This sequencing schedule may also utilize various algorithms embodied in printer software to introduce delays for optimizing particular operations.

Figure 2:
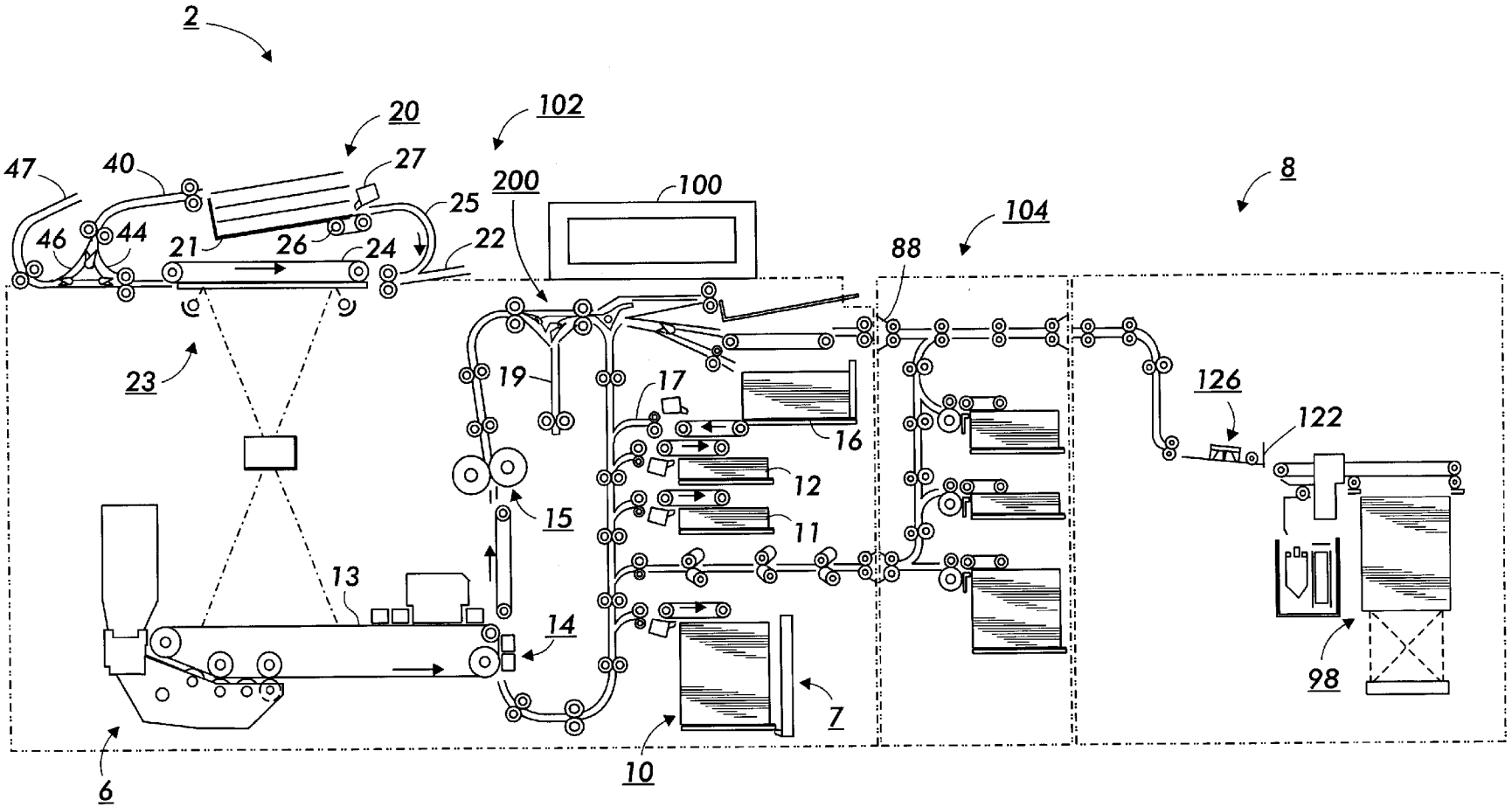
FIG. 2 is a schematic view of a printing machine utilizing the optimized passive gate inverter of FIG. 1.
Figure 3:
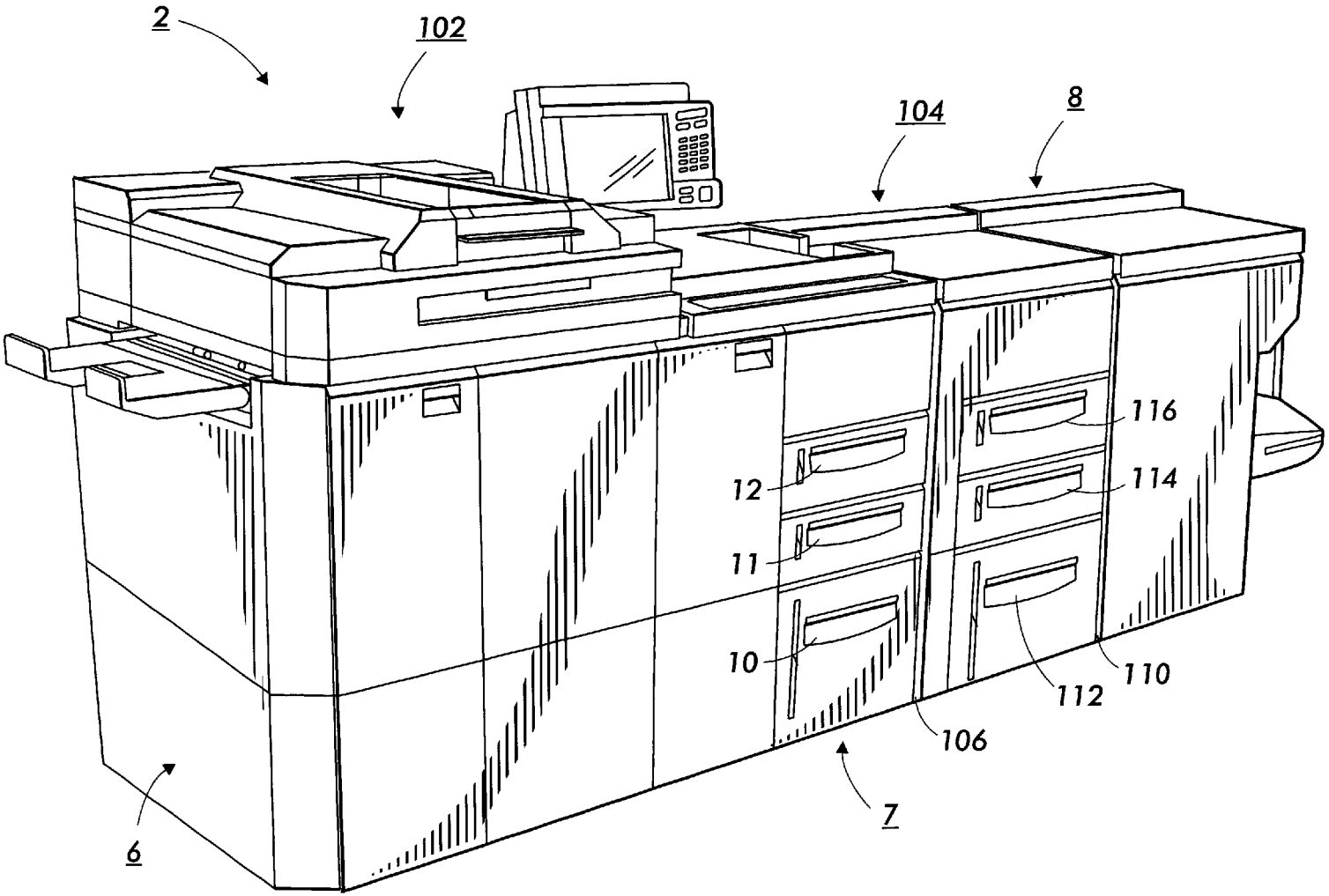
FIG. 3 is a perspective view of the printing machine of FIG. 2.

According to the present invention and referring to FIGS. 2 and 3, a printing system 2 in the form of a copy machine is shown for utilization with a the passive gate inverter apparatus. The copy machine 2 includes printer module 102 including processing section 6 and sheet feeder section 7.

Adjacent printer module 102 an interposer module 104 may be utilized for storing additional sheets for use in the processing section 6 of the printer module or for inserting preprinted or bland divider sheets into the stream of output from the printer module. A first module boundary 106 separates the printer module 102 from the interposer module 104. Finishing section or module 8 is positioned on the opposed side of the interposer module 104 with a second module boundary being formed between finishing section 8 and interposer module 104.

As previously mentioned, the sheet feeder section 7 includes a high capacity feed tray 10 as well as auxiliary paper trays 11 and 12. Paper within the trays 10–12 must pass through interposer module 104 on their way to the finishing section 8 thereby passing by first module boundary 106 and second module boundary 110.

Similarly, the interposer module 104 includes high capacity interposer feed tray 112, lower auxiliary interposer paper tray 114, and upper auxiliary interposer paper tray 116. The trays 112, 114 and 116 serve as sources for paper to pass either directly to the finishing section 8 or to be fed to the processing section 6 of the printer module 102 and subsequently past to the finishing section 8 through interposer module 104. Paper from the interposer paper trays 112, 114 and 116 may pass by first module boundary 106 as well as second module boundary 110.

Referring again to FIG. 2, an optimized passive gate inverter 200 is shown installed in a printing machine 2. As shown in FIG. 2, the passive inverter gate 200 is positioned between fuser 15 and output path 88. The passive inverter gate 200 is utilized to selectively invert a sheet in a stream of sheets.

According to the present invention, and referring now to FIG. 1, the passive gate inverter apparatus 200 is shown in greater detail. The passive gate inverter apparatus 200 is utilized for guiding a sheet 202 in a stream 204 of sheets. The sheet 202 progresses through a paper path 206 of the printing machine 2.

The passive gate inverting apparatus 200 includes an input feed mechanism 208 for feeding the sheets 202 in a first direction 210. The first input feed mechanism 208 may take the form of any feed mechanism capable of advancing the sheet 202 in the first direction 210. For example, the first input feed mechanism 208 may be in the form of a drive roll 212 rotated by motor 214 and a driven roll 216. The sheet 202 is drawn in the first direction 210 at nip 218 between the drive roll 212 and the driven roll 216.

While it should be appreciated that the apparatus 200 for guiding the sheets 202 in the first direction 200 may be configured to direct all the sheets 202 toward reversing chute or inverting chute 220, preferably, the apparatus 200 for guiding sheets preferably includes a diverter 222 for selectively directing the sheets 202 to either a bypass path 224 or an inverting path 226.

The diverter 222 may have any suitable configuration capable of selectively directing the sheet 202 to either the bypass path 224 or the inverting path 226. For example, the diverter 222 may be in the form of a pivotable lever being positively and selectively positioned in either a first diverter position 228 or a second diverter position (show in Phantom) 230. A series of solenoids and cams may be utilized to position the diverter 222 in either of the first position 228 or the second position 230. When positioned in the second position 230, the diverter 222 directs the sheets to go to bypass path 224. When the diverter 222 is in the first position 228, the diverter 222 directs the sheets 202 to the inverting path 226.

The apparatus 200 for guiding sheets further includes a guide 232 in the form of, for example, an inverter inlet baffle. The inverter inlet baffle 232 is associated with the first input feed mechanism 208 for guiding the sheets 202 along the first direction 210. The inverter inlet baffle 232 may be made of any suitable, durable material and may have any suitable shape capable of reliably guiding the sheet 202. For example, the baffle 232 may be in the form of a sheet metal member extending substantially the width of the sheet so that the sheet 202 is thereby supported as it passes along the inverting path 226. Preferably, the inverter inlet baffle 232 has a smooth uniform surface such that leading edge 234 of the sheet 202 is not stubbed or caught by a portion of the baffle 232.

The apparatus 200 for guiding sheets further includes a movable gate 236. The movable gate 236 is operably associated with the guide or baffle 232. The baffle 232 and the guide 236 define a passageway 238 therebetween. The passageway 238 is utilized for passing the sheets 202 therethrough along the inverting path 226.

Figure 6:
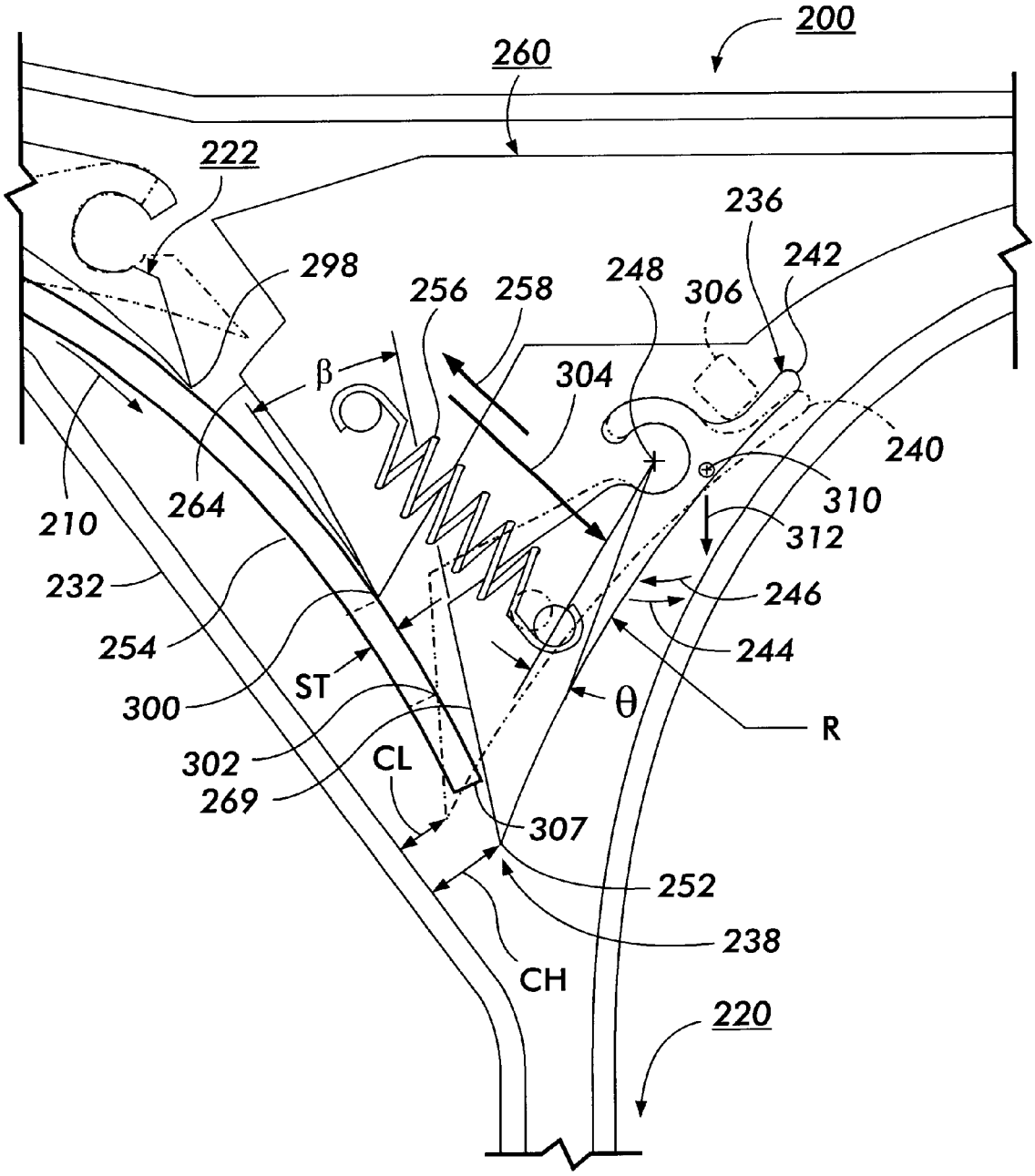
FIG. 6 is a partial schematic plan view of the optimized passive gate inverter of FIG. 1 showing the path of a heavy weight sheet with the gate in the first position.

Referring now to FIG. 6, the movable gate 236 is shown in greater detail. The movable gate 236 may have any configuration capable of providing a movable gate which can move from a first position 240 (shown in phantom) to a second position 242. For example, the gate 236 may move longitudinally along ways (not shown) or as shown in FIG. 6, the movable gate 236 preferably pivots in the direction of arrows 244 and 246 about pivot point 248. The movable gate 236 pivots from the first position 240 to the second position 242 an angle θ of, for example 8° to 26° with 17° being preferred.

The movable gate 236 may be made of any suitable durable material, for example a plastic or a metal. To minimize cost and simplify construction, the movable gate 236 may be made of an aluminum extrusion or a molded plastic part. The movable gate 236 preferably extends in a direction normal to the sheet in FIG. 6, a width substantially equal to the width of the sheet 202.

The movable gate 236 and the baffle 232 co-operate to provide the passageway 238 therebetween with a first width CL when the movable gate 236 is at the first position 240 as shown in phantom. At the first position 240 of the gate 236, thin sheets 250 such as for example, paper of bond quality, for example #15 or #20 rated material, are permitted to pass between the baffle 232 and edge 252 of the gate 236. For example, the thin sheets 250 may have a first thickness FT of for example, 0.002 to 0.005 inches (see FIG. 5).

Referring again to FIG. 6, at first position 240 of the gate 236, thick sheets 254, from passing between the edge 252 of the gate 236 and the baffle 232. The thick sheets 254 may alternatively have a second thickness ST which is less than the first width CL of the passageway 238 at the first position 240, but the impact of the thick, heavy sheet 254 against the gate 236 will move the gate 236 in the direction 244. The thick sheets 254 may represent card stock or sheets having a weight of, for example #110 or greater. The thick sheets 254 may have a thickness ST of, for example 0.005 to 0.012 inches.

The passageway 238 formed between the gate 236 and the baffle 238 defines a second width CH at the second position 242 of the gate 236 which is spaced from the first position 240. The second width CH is selected for passing the thick sheets 254 having a thickness up to and including second thickness ST therethrough. The second width CH of the passageway 238 is selected to inhibit sheets passing therethrough having a thickness greater than a predetermined thickness, for example second width CH. The second width CH is thus considerably wider than the first width CL. The second width CH permits the passage of thick sheets 254 having a thickness ST of, for example 0.005 to 0.012 inches thick.

It should be appreciated that the second width CH may be selected such that thick sheets 254 having the second thickness ST may pass thereby and sheets having a thickness greater than second thickness ST are inhibited from passing thereby. It should be appreciated that the second width CH should be selected such that all commercially available sheets may readily pass thereby. For example, the second width CH should be selected such that at least copy sheets having a rating of #110 be permitted to pass through the passageway 238.

Preferably, as shown in FIG. 6, the movable gate 236 is biased into the first position 240 as shown in phantom. While it should be appreciated that any method for urging the movable gate 236 into the first position 240 may be utilized when practicing the present invention. For example, as shown in FIG. 6, the apparatus 200 for guiding sheets preferably includes an urging member 256 in the form of, for example a coil spring, for urging the gate 236 into the first position 240. The spring 256 provides a spring force SF in the direction of arrow 258 of, for example of 0.2 to 2.0 Newtons with 0.6 Newtons being preferred at the first position 240 and with 0.96 Newtons being preferred at the second position 242. The spring 256 may be positioned a distance from pivot point 248 of, for example 5 to 20 millimeters with 10 millimeters being preferred at the first position 240 and with 12 millimeters being preferred at the second position 242. The preferred moment on the gate 236 from the spring 256 is approximately 6.1 N-mm at the first position 240 and is approximately 11.5 N-mm at the second position 242. If, for example the distance from the pivot point 248 to edge 252 is 24 millimeters, at the second position 242 the spring 256 provides a spring force at edge 252 of approximately 0.5 Newtons.

Preferably, as shown in FIG. 6, the apparatus 200 further includes a fixed member preferably in the form of a fixed middle guide 260. The fixed member 260 is preferably positioned adjacent to the movable gate 236 and opposed to the baffle 232. The fixed member 260 cooperates with the baffle 232 to guide the sheet therebetween.

Figure 5:
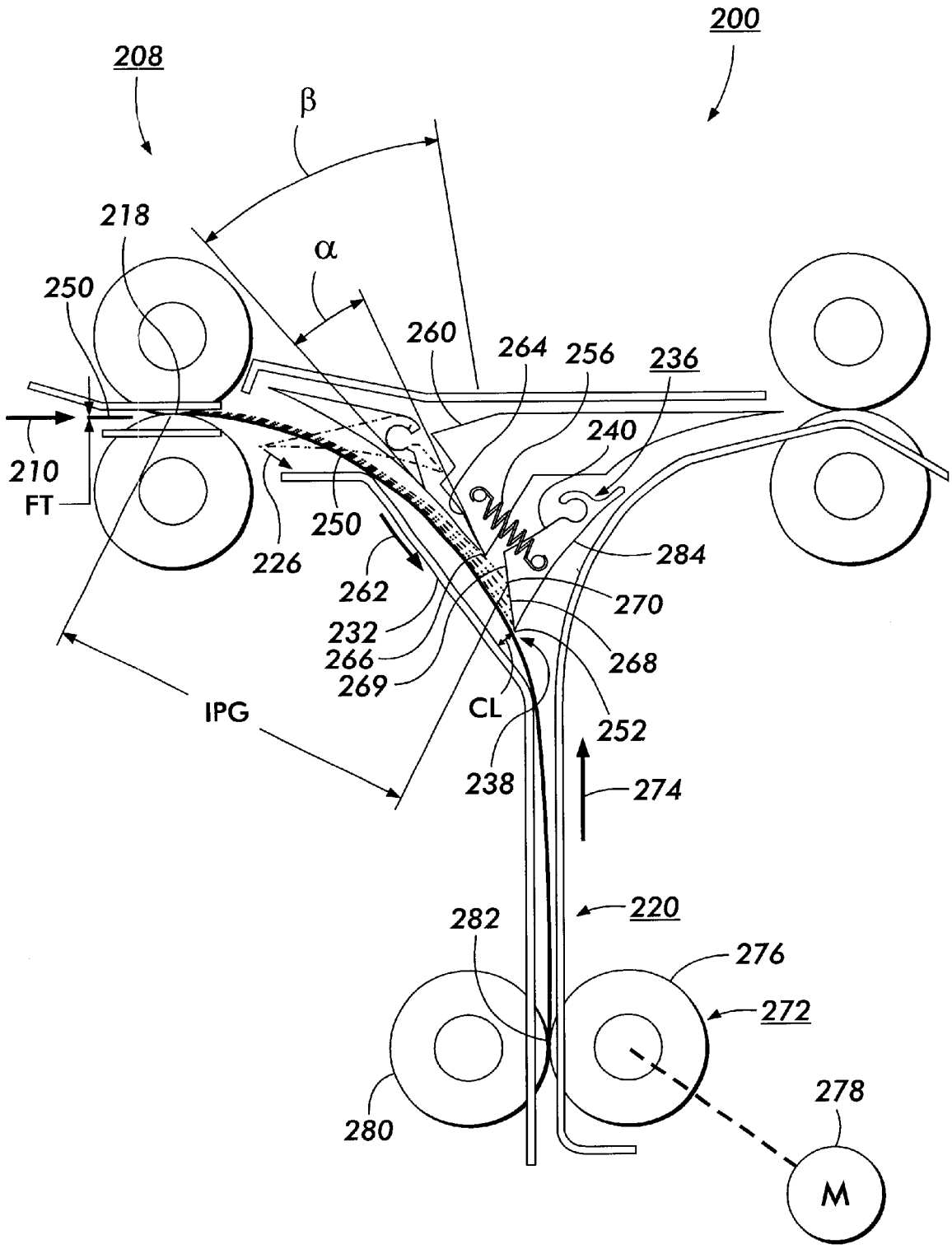
FIG. 5 is a partial schematic plan view of the optimized passive gate inverter of FIG. 1 showing the path of a light weight sheet with the gate in the first position.

Referring now to FIG. 5, the apparatus 200 for guiding sheets is shown with thin lightweight sheets 250 positioned in the inverting path 226. As shown in FIG. 5, the movable gate 236 is in first position 240. The thin sheets 250 advance in first direction 210 along inverter entry path 262 formed between the baffle 232 and the fixed member 260 in cooperation with the gate 236.

As shown in FIG. 5, the thin sheets 250 may, depending on their weight, speed, humidity and other factors, contact the fixed member 260 at fixed member sheet contact surface 264 at contact point 266 at a contact angle $\alpha$ of, for example 5° to 15°. It should be appreciated that the fixed member 260 may be positioned such that at least a portion of the thin sheets 250 may progress along the inverter entry path 262 and be spaced from and not contact the fixed member sheet contact surface 264.

As leading edge 268 of the sheet 250 continues along inverter entry path 262, the leading edge 268 contacts inverter entry sheet gate contact surface 269. The inverter entry sheet gate contact surface 269 is designed to provide for a smooth and easy transition of the lead edge 268 of the sheet 250 along the inverter entry path 262 and into the inverting chute 220.

Preferably, as shown in FIG. 5, the inverter entry sheet gate locating surface 269 is substantially planar and extends the width of the sheet 250 in a direction normal to FIG. 5. It should be appreciated that depending on the stiffness and thickness of the thin sheet 250, the leading edge 268 of the thin sheet 250 may not contact the inverter entry sheet gate contact surface 262 at all and may simply pass along the passageway 238 between the edge 252 of the gate 236 and the baffle 232.

Preferably, as shown in FIG. 5, the inverter entry sheet gate locating surface 269 forms an angle $\beta$ with the thin sheet 250 at contact point 270 of the leading edge 268 of the sheet 250 of, for example, 10° to 60°. Preferably, the angle $\beta$ is approximately 20°.

After the leading edge 268 of the sheet 250 contacts the inverter entry sheet gate contact surface 269, the momentum within the thin sheet 250 causes the leading edge 268 to continue advance in the first direction 210 in a direction parallel and along contact surface 269. Depending on the mass and velocity of the thin sheet 250, the thin sheet 250 may or may not cause the gate 236 to move from the first position 240. The first position 240 is selected such that the passageway 238 formed between edge 252 and the baffle 232 is sufficient to permit thin sheets 250 to pass thereby without moving the gate 236 from its first position 240. Thus, the spring 256 may be selected with sufficient strength and rigidity such that a stiff, reliable and durable spring 256 may be utilized in the apparatus 200.

After the thin sheet 250 reaches the nip 282 within the inverting chute 220, a first reversing feed mechanism 272 which is operably associated with the baffle 232, receives and reverses the sheet 250.

The first reversing feed mechanism 272 may have any configuration capable of driving the sheet 250 in a second direction 274 opposed to first direction 210. For example, the first reversing feed mechanism 272 may include a drive roll 276 driven by motor 278 with the drive roll in contact with a driven roll 280 to form a nip 282 therebetween for reversing the sheet 250. As the thin sheet 250 moves in the direction of arrow 274 being driven by first reversing feed mechanism 272, the leading edge of the thin sheet 250 contacts the inverter existing sheet gate contact surface 284.

Figure 4:
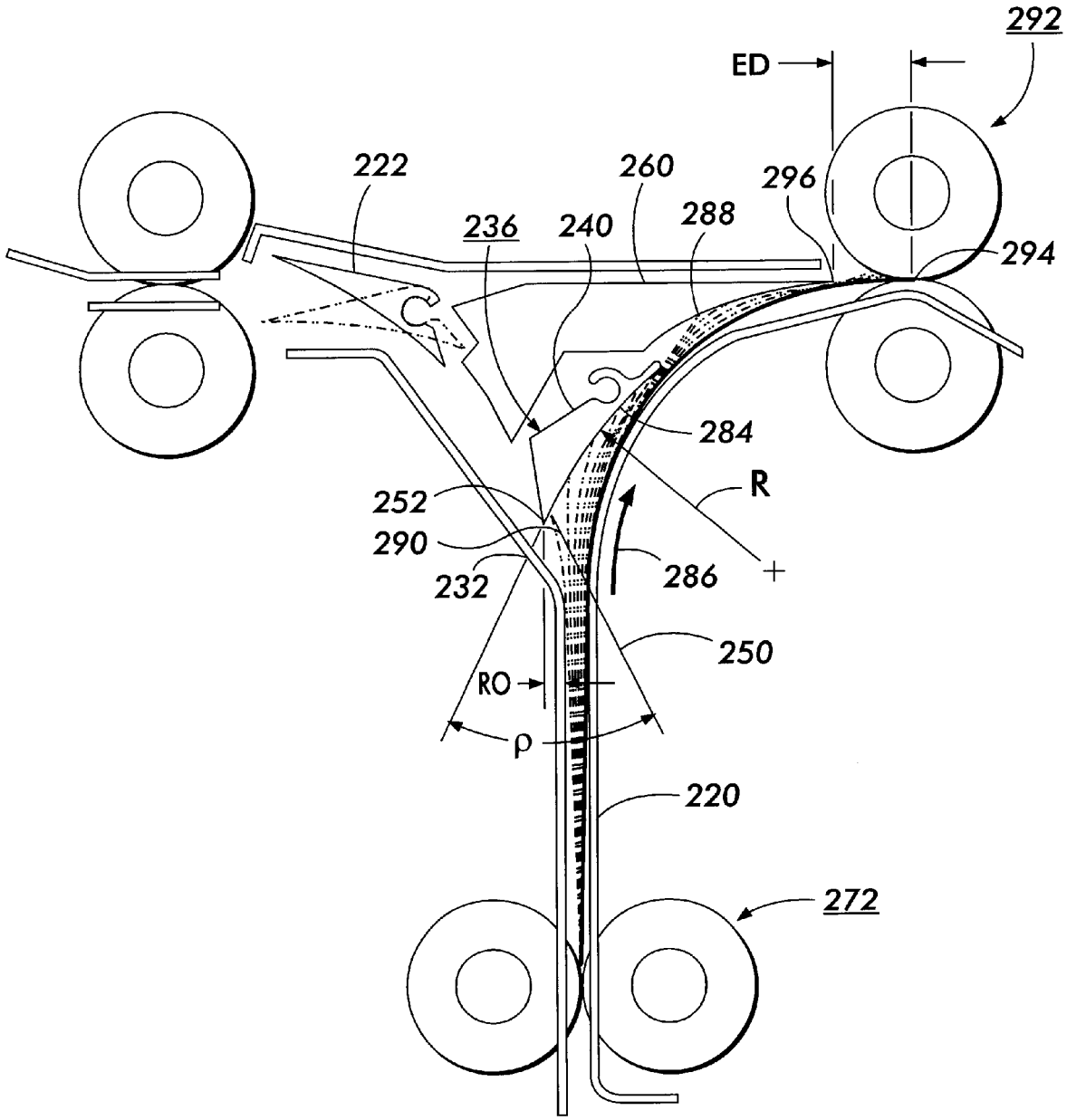
FIG. 4 is a partial schematic plan view of the optimized passive gate inverter of FIG. 1 showing the path of a sheet after inversion.

Referring now to FIG. 4, the sheet 250 is shown in inverter exit path 286. The gate 236 is preferably selected with the inverter entry sheet gate contact surface 284 designed such that leading edge 288 of the sheet 250 may contact surface 284, even a sheet having substantial curl or being very flexible, with a sufficient contact angle such that the sheet 250 continues along the inverter exit path 286.

For example, as shown in FIG. 4, with the gate 236 in first position 240, edge 252 of the gate 236 is positioned with a reverse offset RO from a line extending upward from baffle 232 of the chute 220 a reverse offset RO of, for example 0.30 inches so that a sheet 250 such as sheet 290 with a curl in the direction of the gate 236 will contact the inverter exiting sheet gate contact surface 284 at a contact angle $\rho$ which is less than 90° so that the leading edge 288 may continue along the contact surface 284 of the gate 236 in the direction of the inverter exit path 286.

Preferably, as shown in FIG. 4, the apparatus for inverting sheets 200 further includes an output feed mechanism. The output feed mechanism 292 includes a nip 294 at which the leading edge 288 of the sheet 250 is drawn further in the direction of inverter exit path 286.

Preferably, as shown in FIG. 4, the fixed member 260 includes a fixed member edge 296 which is positioned a distance, for example ED of for example 0.05 to 0.15 inches from the nip 294 to minimize the disturbance of the sheet 250 as it enters the nip 294. Preferably, the point 296 is positioned along a line extending through the nip 294 of the second feed mechanism 292.

The inverter exiting gate sheet contact surface 284 of the gate 236 preferably has a concave surface defined by radius R of, for example 4 inches. The concave surface of the contact surface 284 serves to help guide the leading edge 288 in the direction of exit path 286.

Referring again the FIG. 6, the movable gate 236 is shown in solid in the second position 242 so that thick sheets 254 having a thickness ST of, for example 0.005 to 0.012 inches, may pass along the passageway 238. The thick sheets 254 have a stiffness and a mass such that the thick sheets 254 tend to advance generally straight along the first direction 210. For example, as shown in FIG. 6, the thick sheet 254 advances from edge 298 of the diverter 222 into contact with fixed member sheet contact surface 264 at contact point 300 and then advances in the first direction 210 into contact with inverter entry sheet gate contact surface 269 at first contact point 302 with the gate 236 at first position 240.

The thick sheet 254 has a sufficient mass and velocity such as to overcome the spring force SF of the urging member spring 256 so as to move the movable gate 236 in the direction of arrow 304 toward the second position 242. As the gate 236 moves from the first position 240 to the second position 242, leading edge 307 of the thick sheet 254 advances in the direction of arrow 210 along the gate contact surface 269 toward the passageway 238. When the gate 236 is in the second position 242, the passageway 238 has a second width CH sufficient to permit the thick sheets 254 with a thickness ST to pass therethrough and to continue along in the first direction 210 toward the inverter chute 220.

While it should be appreciated, as shown in FIG. 6, that the movable gate 236 is biased toward the first position 240 by any suitable method, for example spring 256, other methods of biasing the gate 236 toward the first position 240 may be used. For example, the apparatus 200 for inverting sheets may include a weight 306 (shown in phantom) attached to the movable gate 236. The weight 306 is positioned with respect to the pivot point 248 of the gate 236 such that the gate 236 combined with the weight 308 has a center of gravity 310 as shown in FIG. 6 which causes a gravitational force in the direction of arrow 312, thereby urging the movable gate 236 toward the first position 240. It should be appreciated that the movable gate 236 may have suitable shape such that a separate weight 306 may not be required, but merely the movable gate 236 itself may have a center of gravity similar to center of gravity 308 as shown in FIG. 6.

It should also be appreciated that the movable gate 236 may be made of a pliable material such that the movable gate 236 is in an unrestrained position at first position 240 and is a restrained position at second position 242. Thus, if the movable gate is made of a flexible material and so positioned, the movable gate may not require a separate urging member or even a center of gravity as shown in FIG. 6.

Referring again to FIG. 5, the contact surface 269 of the gate 236 is preferably positioned close, for example, a distance IPG of for approximately 2 inches or less, to the nip 218 of the input feed mechanism 208 to take advantage of the sheet stiffness to offer reliable motion of the gate 236 as it rotates from the first position 240 to the second position 242.

By providing an apparatus for inverting sheets including a spring biased movable gate, a mechanism such as a solenoid or mechanical actuator is not required to move the gate from a first to a second position. The inherent reliability problems of a solenoid or similar mechanism are thus avoided.

By providing a movable gate with a spring for urging the gate toward one of two positions, a solenoid or other mechanism is not required thus eliminating the timing issues necessary for the solenoid or other mechanism actuation and deactuation.

By providing a mechanism for inverting sheets including a gate and guide designed to minimize stubbing of curled sheets, the stubbing or catching of the lead edge of curled sheets in the inverter path and the resultant jams may be avoided.

By providing an apparatus for inverting sheets including a gate which has an edge offset in the reverse path, a gate recess or groove in the baffle which may cause the sheets to stub or jam may be eliminated.

By providing an apparatus for inverting sheets including a gate which pivots about a pivot point selected to eliminate the need for a gate recess in the baffle forming the inverter inlet path, stubbing or catching of the lead edge of the sheet in the inverter path may be avoided.

By providing an apparatus for inverting sheets including a pivoting gate having a pivot point providing sheet lead edge contact points in the entry path and the exit path to and from the inverter designed to avoid stubbing and catching of the lead edge of the sheets in the inverter path, jamming of the sheets in the inverter path may be avoided.

By providing an apparatus for inverting sheets including a pivoting spring biased gate with a narrow passageway for bond sheets and a wide passageway for card stock, an inverting mechanism may be provided which is suitable for a very wide range of sheet thicknesses, weights, and rigidity.

By providing an apparatus for inverting sheets including a passive gate permitting passage of thin, lightweight sheets without moving the passive gate, a passive gate may be provided for the apparatus which utilizes a stiffer, more reliable spring.

It is, therefore, evident that there has been provided, in accordance with the present invention, an electrostatographic copying apparatus that fully satisfies the aims and advantages of the invention as hereinabove set forth. While the invention has been described in conjunction with a preferred embodiment thereof, it is evident that many alternatives, modifications, and variations will be apparent to those skilled in the art. Accordingly, it is intended to embrace all such alternatives, modifications and variations as fall within the spirit and broad scope of the appended claims.

We claim:

1. An apparatus for an imaging machine comprising:

a guide for guiding at least one sheet; and a movable gate operably associated with the guide, the movable gate and the guide defining an open passageway therebetween for passing the at least one sheet therethrough, the open passageway adapted to adjust from a first width greater than zero to a second width greater than the first width.

2. The apparatus as claimed in claim 1, wherein the movable gate pivots.

3. The apparatus as claimed in claim 2 wherein the movable gate includes a center of gravity and a pivot point and wherein a position of the center of gravity of the movable gate with respect to a pivot point is selected to urge the movable gate toward the first width.

4. The apparatus as claimed in claim 1, further comprising a diverter mechanism operably associated with the guide for diverting the at least one sheet from a stream of sheets into an inverting path.

5. The apparatus as claimed in claim 1, wherein the movable gate is adapted to be urged from the first width to a width greater than the first width as the at least one sheet having a thickness greater than the first width contacts the gate.

6. The apparatus as claimed in claim 1, further comprising an urging member for urging the movable gate toward the first width.

7. The apparatus as claimed in claim 1, wherein a thickness of the at least one sheet is from about 0.002 inches to about 0.012 inches.

8. The apparatus as claimed in claim 1, further comprising:

a reversing chute operably associated with the guide for receiving the at least one sheet and for reversing thereof; and a reversing feed mechanism associated with the reversing chute for directing the at least one sheet.

9. The apparatus as claimed in claim 1, wherein the guide comprises a fixed member positioned adjacent to the movable gate and opposed to the guide and cooperating with the guide to direct the at least one sheet to the open passageway.

10. An inverting apparatus for an imaging machine comprising:

a guide for guiding the at least one sheet;

a movable gate operably associated with the guide, the movable gate and the guide defining an open passageway therebetween for passing the at least one sheet therethrough, the open passageway adapted to adjust from a first width greater than zero to a second width greater than the first width;

a reversing chute operably associated with the guide for receiving the at least one sheet and for reversing direction thereof; and a feed mechanism associated with the reversing chute for directing the at least one sheet.

11. A xerographic machine comprising:

an input feed mechanism for feeding at least one sheet;

a guide operably associated with the input feed mechanism for guiding the at least one sheet;

a movable gate operably associated with the guide, the moveable gate and the guide defining an open passageway therebetween for passing the at least one sheet therethrough, the open passageway adapted to adjust from a first width greater than zero to a second width greater than the first width;

a reversing chute operably associated with the guide for receiving the at least one sheet for reversing direction thereof; and a feed mechanism associated with the reversing chute for directing the at least one sheet.

12. The xerographic machine as claimed in claim 11, wherein the movable gate rotates about a pivot point.

13. The xerographic machine as claimed in claim 12, wherein a center of gravity of the movable gate with respect to a pivot point of the movable gate is selected so as to urge the movable gate toward the first width.

14. The xerographic machine as claimed in claim 11, further comprising a diverter operably associated with the guide for selective diverting of a sheet from a stream of sheets into an inverting path.

15. The xerographic machine as claimed in claim 11, wherein the movable gate is urged from the first width to a width greater than the first width as the at least one sheet contacts the movable gate.

16. The xerographic machine as claimed in claim 11, further comprising an urging member for urging the movable gate toward the first width.

17. The xerographic machine as claimed in claim 11, wherein a thickness of the at least one sheet is approximately 0.002 inches to 0.012.

18. The xerographic machine as claimed in claim 11, wherein the guide comprises a fixed member positioned adjacent to the movable gate and opposed to the guide and cooperating with the guide to direct the at least one sheet therebetween to the open passageway.

19. The xerographic machine as claimed in claim 11, further comprising an output feed mechanism spaced from and downstream from the feed mechanism for directing the at least one sheet; and wherein the fixed member includes a portion thereof spaced approximately 0.050 to 0.150 inches from the output feed mechanism.

* * * * *